United States Patent [19]

Hayden

[11] Patent Number: 5,004,428

[45] Date of Patent: Apr. 2, 1991

[54] VACUUM SYSTEM ATTACHMENT

[76] Inventor: Theodore R. Hayden, 10291 Springhill Crescent, Richmond, British Columbia V7E 1W7, Canada

[21] Appl. No.: 537,167

[22] Filed: Jun. 11, 1990

Related U.S. Application Data

[63] Continuation of Ser. No. 462,904, Jan. 5, 1990, abandoned, which is a continuation of Ser. No. 236,929, Aug. 25, 1988, abandoned.

[51] Int. Cl.[5] ..... H01R 4/60

[52] U.S. Cl. ..... 439/191; 15/314

[58] Field of Search ..... 439/190, 191, 192, 193, 439/194, 195; 15/22 R, 314, 361; 174/47; 200/61.6; 285/7

[56] References Cited

U.S. PATENT DOCUMENTS

| | | | |
|---|---|---|---|
| 3,034,085 | 5/1962 | Pauler et al. | 15/314 |
| 3,258,553 | 6/1966 | Breslin | 439/191 |

FOREIGN PATENT DOCUMENTS

| | | |
|---|---|---|
| 917705 | 12/1972 | Canada . |
| 1103718 | 6/1981 | Canada . |
| 1147372 | 5/1983 | Canada . |
| 1244501 | 11/1988 | Canada . |

*Primary Examiner*—Neil Abrams
*Assistant Examiner*—Khiem Nguyen
*Attorney, Agent, or Firm*—Christie, Parker & Hale

[57] ABSTRACT

An endpiece for a vacuum hose of a central vacuum system. There is a body having first and second ends. A nozzle projects outwardly from the first end and to go into an inlet valve of a central vacuum system. An opening in the second end receives the vacuum hose. A pathway through the body, communicates the nozzle and the opening in the second end. A connector on the body is generally adjacent the first end and a conductor joins the connector to the second end so that electrical current can be conducted from the connector to the second end of the body.

2 Claims, 1 Drawing Sheet

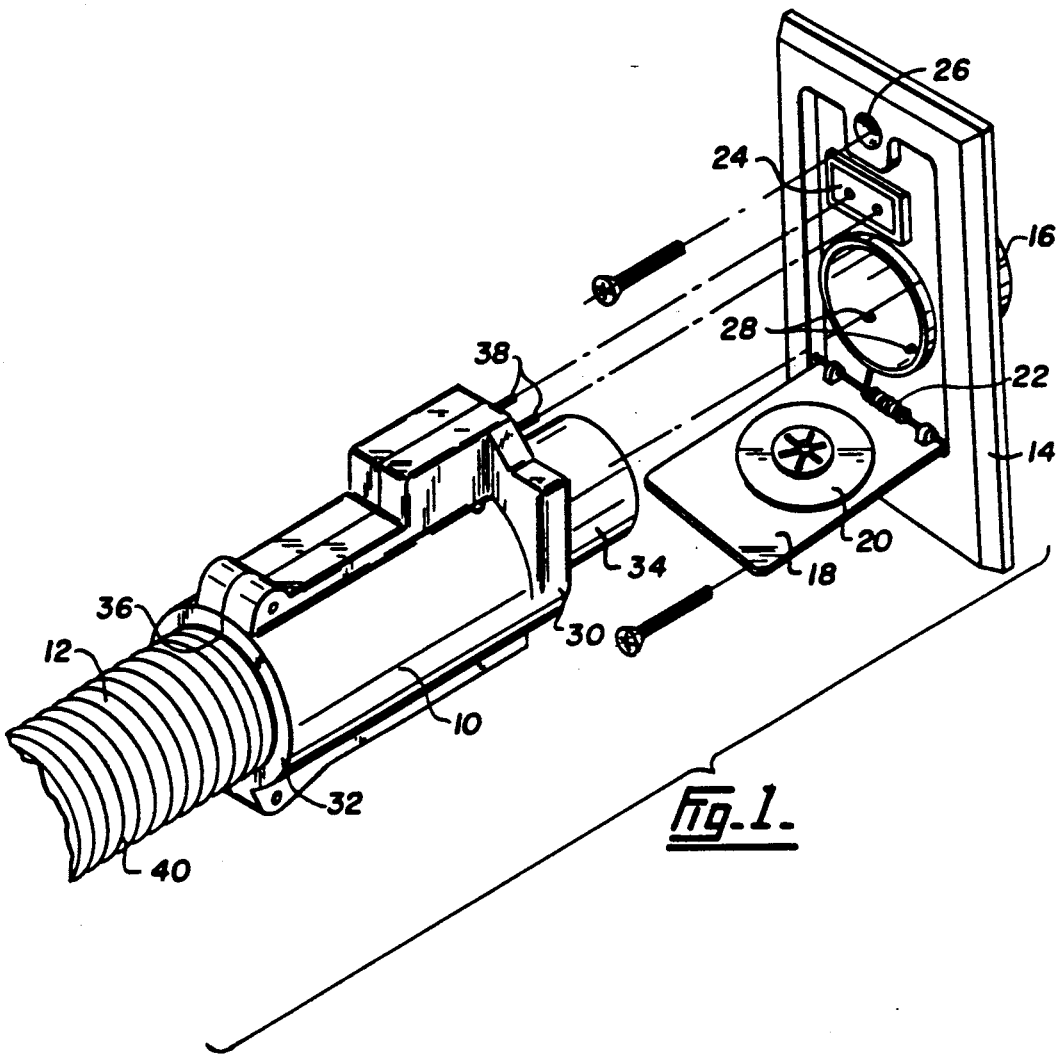
Fig. 1.
Fig. 2.
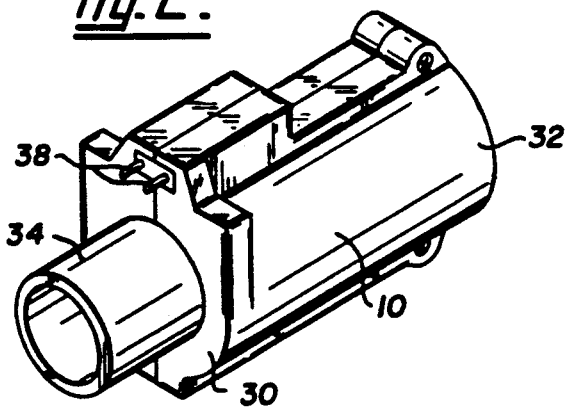
Fig. 3.
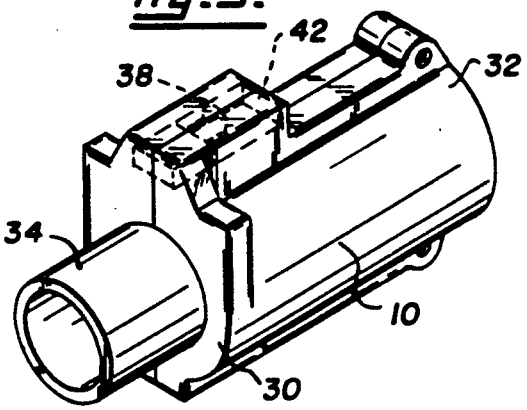

VACUUM SYSTEM ATTACHMENT

This is a continuation of application Ser. No. 07/462,904, filed Jan. 5, 1990, which is a continuation of application Ser. No. 07/236,929, filed Aug. 25, 1988, both now abandoned.

FIELD OF THE INVENTION

This invention relates to an endpiece for a vacuum hose of a central vacuum system. The endpiece is that part of the vacuum hose that fits into a wall outlet.

DESCRIPTION OF THE PRIOR ART

Central vacuum systems are increasingly popular. They comprise a central dirt collecting source and a powerful impeller to generate suction located at that source. The building in which the system is located then has a number of simple wall outlets, not unlike electrical outlet plates, at appropriate locations. It is now virtually standard to have a switch built into the outlet so that insertion of the metal probe of a vacuum hose acts to contact a low voltage supply, which operates the impeller. The hose is then extended from the wall outlet to a simple nozzle. The nozzle may be operated with a brush but the general idea is to suck the dirt into the system and into the central dust collector. This is in marked contrast to the necessity to have to carry around a traditional vacuum cleaner from room to room. Using these central vacuum systems it is only necessary to carry around a lightweight flexible hose.

As indicated the central vacuum system is typically operated by an impeller or fan operating on 24 volts. This has proved to be perfectly adequate. However, there is occasionally a need to use 120 volt appliances with a central vacuum system, for example to operate beaters and the like so that carpets may be given an occasional more thorough cleaning.

This has been a disadvantage with the prior art systems. Applicants' U. S. prior application, Ser. No. 059,885, filed by June 1987 as a continuation-in-part of application Ser. No. 829,270 filed Feb. 14, 1986 , now U.S. Pat. No. 4,758,170, issued July 19, 1988, shows an inlet valve for a central vacuum system. The valve has an inlet valve body having an electrical receptacle adjacent an air suction inlet. This allows a simultaneous connection of relatively high voltage components. However, it is still desirable to provide a more compact system, for example in which the leads for the high voltage system can be formed in close association with the hose of the vacuum system thus reducing the hazards of having cables lying around while one is operating the vacuum system. The present invention provides an end piece for a vacuum hose that meets this need.

SUMMARY OF THE INVENTION

Accordingly the present invention is an endpiece for a vacuum hose of a central vacuum system comprising:

a body having first and second ends;

a nozzle projecting outwardly from the first end and adapted to be received in an inlet valve of a central vacuum system;

an opening in the second end to receive the vacuum hose;

a pathway through the body, communicating the nozzle and the opening in the second end;

connector means on the body, generally adjacent the first end;

conductor means joining the connector means to the second end whereby electrical current is conducted from the connection means to the second end of the body.

BRIEF DESCRIPTION OF THE DRAWINGS

Aspects of the invention are illustrated in the drawings, merely by way of example, in which:

FIG. 1 shows an endpiece according to the present invention and its associated wall fitting;

FIG. 2 illustrates a fitting according to the present invention;

FIG. 3 shows a modification of the invention.

The drawings show an end piece 10 for a vacuum hose 12 of a central vacuum system. The only part of the central vacuum system that is shown is the end plate 14 which comprises a plate to be fitted against the wall, a pipe 16 which communicates with an impeller (not shown), a flap 18, including a sealing member 20 for the pipe 16, that is urged by spring 22 to close the pipe 16, an electrical socket 24 and screw holes 26 so that the plate 14 may be mounted against the wall. As is conventional the pipe 16 includes switches 28, typically spring loaded, which form a circuit when connected by a metal pipe received within pipe 16.

The flap 18 is spring loaded to the closed position but can, of course, maintained in the open position by the presence of a pipe.

The endpiece 10 according to the invention comprises a body having a first end 30 and second end 32. A nozzle 34 projecting outwardly from the first end 30 is adapted to be received in the inlet pipe 16 of the central vacuum system. There is an opening 36 in the second end 32 to receive the vacuum hose 12 and a pathway extends through the endpiece 10, communicating the nozzle 34 and the opening 36 in the second end 32 and thus the hose 12. There are connector means comprising prongs 38 on the body, generally adjacent the first end 30, and adapted to engage the socket 24 of the wall plate 14. It is particularly important to note that the endpiece 10 is dimensioned so that when the nozzle 30 fits within the pipe 16, the prongs 38 are automatically aligned correctly with the socket 24 in the plate 14. Within the endpiece 10 there are conductors joining the prongs 38 to the second end 32 whereby electrical current is conducted from the socket 24 to the second end 32 of the endpiece 10.

As shown in FIG. 1, hose 12 extends outwardly from the second end 32 and there is a cable 40 associated with the hose 12, typically by being wrapped around the hose. There are means electrically connecting the cable 40 to the second end 32 of the endpiece 10. For example, the cable 40 may extend into the endpiece 10 to make contact with the prongs 38 or there may be provided additional electrical connectors at the second end 32 of the endpiece 10 and corresponding connectors at the end of the cable 40 so that electrical connections may be made by joining the two components.

To use the apparatus shown in FIGS. 1 and 2 the flap valve 18 is held downwardly and the nozzle 34 inserted into the pipe 16, simultaneously injecting the prongs 38 into the socket 24. The low voltage circuit needed to operate the fan is thus completed by insertion of the metal nozzle 34, joining the switches 28, and the high voltage circuit is completed by inserting the prongs 38 into the socket 24. The vacuum system is operated and a higher voltage system, for example, to drive a carpet beater, is also operated.

It is desirable to incorporate a switch into the carpet beater system and, in that regard, attention is directed to the disclosure of such an arrangement in the copending U.S. patent application, entitled 'Central Vacuum System Apparatus', filed on even date herewith in the name of Theodore R. Hayden and assigned Serial No. 237,213 the entire disclosure of which is incorporated herein by reference.

The embodiment of FIG. 3 differs from that of FIG. 2 in that it is useful with a face plate not shown in FIG. 1 but, for example, as known in the prior art. That is, it is not necessary that socket 24 of applicant's plate 14 be present. Instead the prongs 38 extend outwardly from end 30 within a cavity 42. This permits power to be taken, for example from a conventional wall socket, to these prongs 38 by an additional cable. The prongs 38 are connected to the cable 40 that extends along the hose, as for the FIGS. 1 and 2 embodiment.

I claim:

1. An endpiece for a vacuum hose of a central vacuum system comprising:

a body having first and second ends;

a nozzle projecting outwardly from the first end and adapted to be received in an inlet valve of a central vacuum system;

an opening in the second end to receive the vacuum hose;

a pathway through the body communicating the nozzle and the opening in the second end;

connector means on the body, generally adjacent the first end comprising a pair of prongs located in a protective cavity formed integrally with the body that opens toward said second end and extends away from the inlet valve to allow connection to an electrical power source;

the second end being electrical connected to the connector means whereby electrical current is conducted from the connector means to the second end of the body.

2. An endpiece as claimed in claim 1 including a hose extending from the second end, and a cable associated with the hose that is electrically connected, to the second end of the body whereby current is conducted from the connector means to the cable.

* * * * *